US006012661A

United States Patent [19]

Duchi

[11] Patent Number: 6,012,661

[45] Date of Patent: Jan. 11, 2000

[54] METHOD FOR AUTOMATICALLY CONTROLLING GRINDING WITHIN A MILLING PLANT, AND PLANT FOR IMPLEMENTING THE METHOD

[75] Inventor: Giorgio Duchi, Padua, Italy

[73] Assignee: Braibanti Golfetto S.p.A., Padua, Italy

[21] Appl. No.: 09/147,172

[22] PCT Filed: Apr. 10, 1997

[86] PCT No.: PCT/EP97/01784

§ 371 Date: Oct. 23, 1998

§ 102(e) Date: Oct. 23, 1998

[87] PCT Pub. No.: WO97/41956

PCT Pub. Date: Nov. 13, 1997

[30] Foreign Application Priority Data

May 2, 1996 [IT] Italy ..... VE96A0015

[51] Int. Cl.[7] ..... B02C 25/00

[52] U.S. Cl. ..... 241/30; 241/37

[58] Field of Search ..... 241/30, 37, 79.1, 241/143, 144, 145

[56] References Cited

U.S. PATENT DOCUMENTS

| | | | |
|---|---|---|---|
| 3,716,196 | 2/1973 | Motek et al. | 241/37 |
| 4,881,689 | 11/1989 | Lippuner et al. | 241/37 |
| 5,407,138 | 4/1995 | Graenicher et al. | 241/37 |

FOREIGN PATENT DOCUMENTS

| | | |
|---|---|---|
| 0 013 023 | 7/1980 | European Pat. Off. . |
| 0 433 498 | 6/1991 | European Pat. Off. . |
| 24 13 956 | 9/1974 | Germany . |
| 92 03 754 | 5/1992 | Germany . |
| 6-114282 | 4/1994 | Japan . |
| WO 86/05416 | 9/1986 | WIPO . |

*Primary Examiner*—Mark Rosenbaum

*Attorney, Agent, or Firm*—Hoffman, Wasson & Gitler

[57] ABSTRACT

A method for automatically controlling grinding within a milling plant comprising a plurality of grinding stations, wherein by effecting, at the exit of at least one grinding station, at least one sifting of a sample and comparing the passed-through/withdrawn sample percentage value with previously programmed standard values, and adjusting the gap between the rolls of said grinding station on the basis of the deviation from these values.

6 Claims, 2 Drawing Sheets

METHOD FOR AUTOMATICALLY CONTROLLING GRINDING WITHIN A MILLING PLANT, AND PLANT FOR IMPLEMENTING THE METHOD

FIELD OF THE INVENTION

This invention relates to a method for automatically controlling grinding within a milling plant, and a plant for implementing the method.

DESCRIPTION OF THE PRIOR ART

The current requirements of the milling market require substantially the use of many types of grains and a large number of qualitatively constant types of flour, both because the consumer requires many varieties of bread and because the production of deep-frozen products and sweets requires an increasingly larger number of special flours.

For this reason the type of grain mixture has to be frequently changed within the milling plant, resulting in a specialized personnel requirement for optimizing plant control.

An object of the invention is to provide a method which enables grinding control in a milling plant to be optimized without requiring the use of specialized personnel or at least reducing the time for which such personnel is used.

BRIEF SUMMARY OF THE INVENTION

This object and further ones are attained according to the invention through a method for automatically controlling grinding within a milling plant comprising a plurality of grinding stations, comprising the steps of:

- effecting, at the exit of at least one grinding station, at least one sifting of a sample,
- comparing the passed-through/withdrawn sample percentage value with previously programmed standard values, and
- adjusting the gap between the rolls of said grinding station on the basis of the deviation from these values.

To carry out the method the invention foresees a plant for implementing the method claimed, comprising:

- a plurality of grinding stations,
- a plurality of ducts leaving each grinding station and put into communication with a single duct by switching a flap provided at their juncture point,
- a sifter consisting of at least two superposed sieving units, the exits of which communicate respectively with a first balance and with a second balance, the upper unit communicating only with the first balance, the lower unit communicating only with the second balance, and the intermediate units communicating with said first or second balance by programming,
- a data processing system which compares the contents of one balance as a percentage of the contents of both balances with previously memorized values for that type of grinding, and on the basis of the deviation varies the gap between the rolls of the grinding station.

BRIEF DESCRIPTION OF THE DRAWINGS

A preferred embodiment of the present invention is described in detail hereinafter with reference to the accompanying drawings, in which.

DESCRIPTION OF PREFERRED EMBODIMENTS

Figure 1:
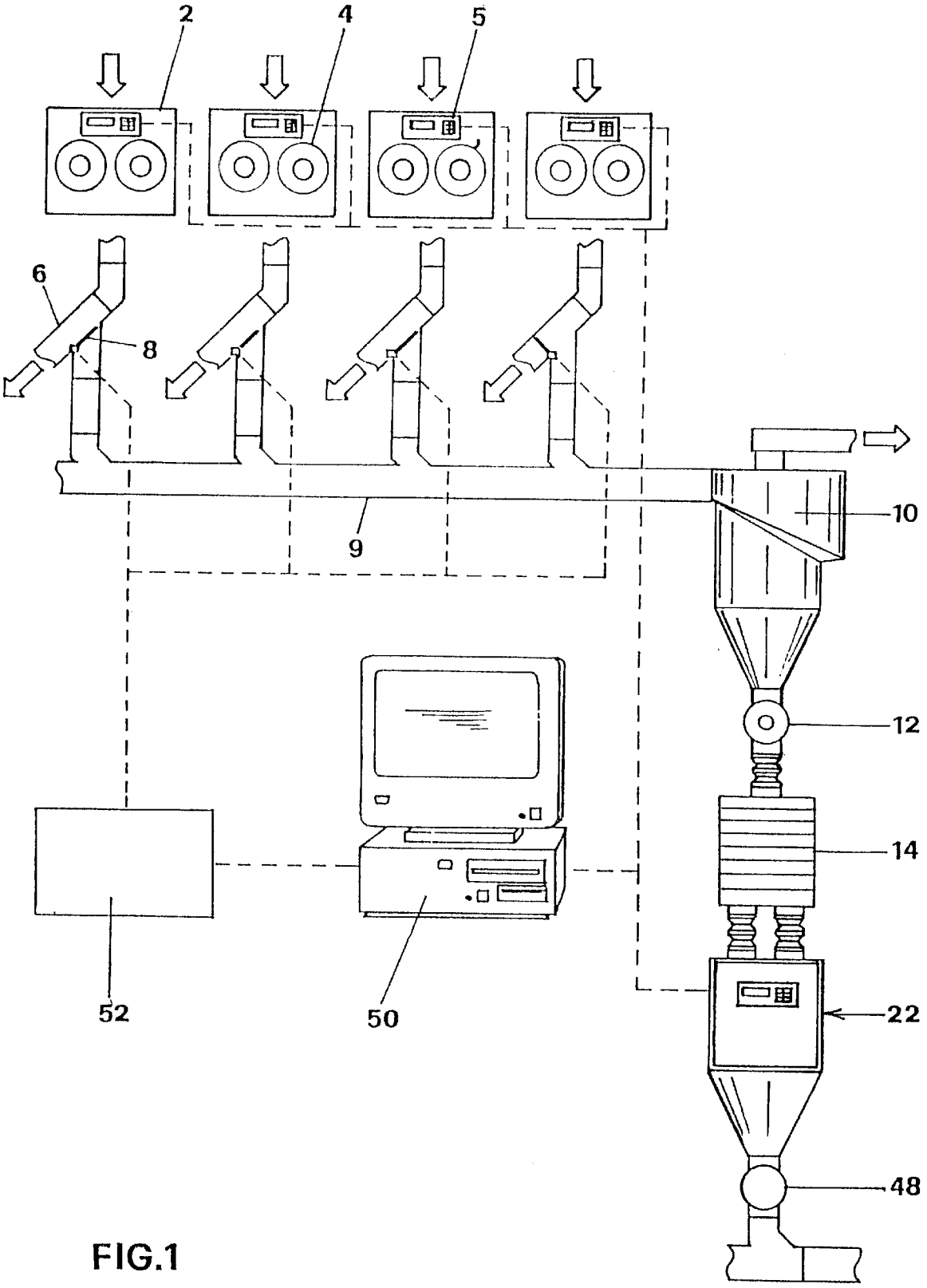
FIG. 1 is a block diagram of the plant for implementing the method of the invention.
Figure 2:
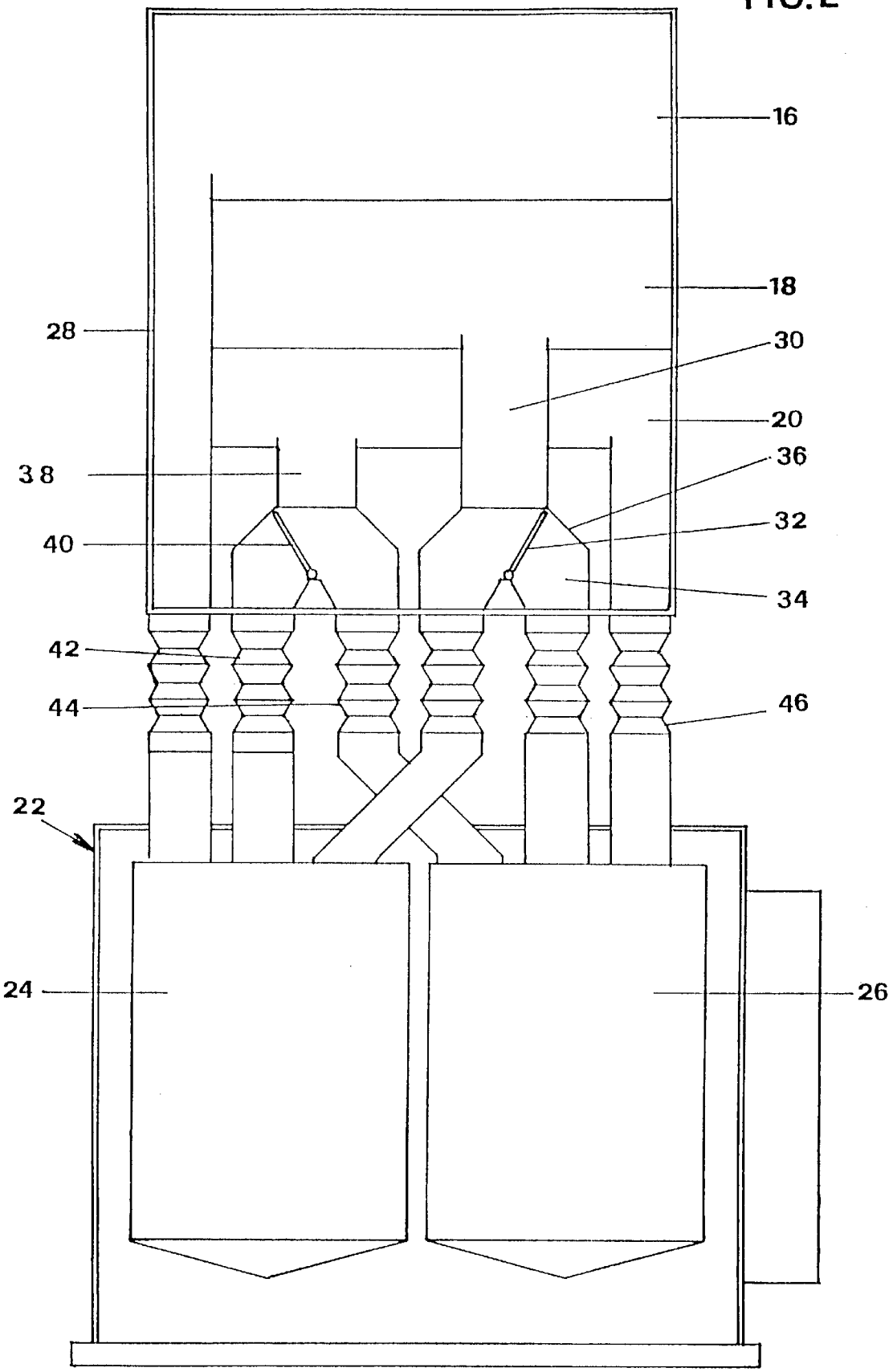
FIG. 2 shows the plant section relative to the sifting station.

As can be seen from the figures, the method of the invention uses a plant comprising a plurality of grinding stations 2 each of which comprises a pair of grinding rolls 4 provided with devices 5 for adjusting the passage gap. This adjustment system is known and therefore does not form part of the invention.

At the exit of each station 2 there is provided a duct 6 comprising a deviator flap 8 which connects it to a duct 9 operating under vacuum and common to all the ducts 6.

The duct 9 is connected to a cyclone 10 provided lowerly with a metering device of adjustable throughput feeding a single-casing sifter 14 provided with devices (not shown on the drawings) which impress on it an oscillatory movement in a horizontal plane.

The sifter 14 comprises substantially three sets of superposed sieves 16, 18, 20 of different grades with their free area decreasing from the top downwards.

Each set of sieves 16, 18, 20 is also provided with a duct for discharging rejects to a weighing machine 22 comprising two balances 24, 26, the first balance 24 forming the rejects collector vessel and the second balance 26 forming the collector vessel for the material which passes through.

Specifically:

- the upper set of sieves 16 is provided with an exit duct 28 connected to the balance 24 containing the rejects,
- the intermediate set of sieves 18 is provided with a rejects discharge duct 30 provided with a deviator flap 32 which connects it to two ducts 34, 36 connected respectively to the balance containing the rejects and the balance containing the material which has passed through,
- the lower set of sieves 20 is provided with a rejects discharge duct 38 provided with a deviator flap 40 which connects it to two ducts 42, 44 connected respectively to the balance containing the rejects and the balance containing the material which has passed through.

In a position below the lowest sieve 20 there is provided a duct 46 connected to the balance 26 containing the material which has passed through.

Finally, an unloader 48 is provided below the sifter 14 to empty the balances.

The plant also uses a control unit 50 which controls the adjustment of the gap between the grinding rolls 4 and the movement of the sifter deviator flaps.

Said control unit is also connected to an electronic scanning unit 52 controlling the movement of the deviators 8.

The plant of the invention also comprises a plurality of control, operating and conditioning devices of known type ensuring correct progress of the operating cycle and mentioned when appropriate in the ensuing description of operation of one grinding station, but which is also valid for the other stations.

By means of cyclic logic programmed by the electronic controller 52, the deviator 8 is switched so that a certain quantity of ground product is drawn into the duct 9, to be fed to the cyclone 10.

During this stage the withdrawal time is recorded so as to be able to make a reliable estimate of the flow rate on the basis of the ratio of the quantity withdrawn to the duration of withdrawal.

The withdrawn sample leaving the cyclone 10 is fed to the sifter 14 via the metering device 12 of variable throughput, enabling the quantity treated per unit of time to be controlled.

During this stage the control unit 50 has already set the deviators 32, 40 to a determined configuration corresponding to a value representing the percentage of passed-through material to the total sample, and previously memorized for that type of grinding.

Consequently, in passing through the meshes of the sifter sieve set, the sample is classified into four different particle size distributions, of which the smallest, representing the passed-through material, leaves from the duct 46, the largest, representing the rejects, leaves from the duct 18 and the intermediates are fed into the balances 24 and 26, according to the position of the deviators.

After this sifting operation, the weighing machine measures the withdrawn sample quantity and the percentage of passed-through material to the total sample. These values are fed to the control unit 50 which compares them with the previously defined standard values previously memorized for that type of grinding.

If these values do not coincide with the standard values and are also outside the set tolerance bands, the control unit 50 causes that grinding station 2, downstream of which the withdrawal has been made, to vary the gap between the grinding rolls in accordance with predefined parameters.

The balances are then emptied, ready to receive a new sample originating from another station in a predefined sequence.

From the aforegoing it is apparent that the method of the invention presents numerous advantages, and in particular:

it enables the predetermined degree of extraction to be obtained completely independently of subjective factors, the result of the grinding can be analyzed with a reasonably rapid frequency (15–20 minutes), hence enabling a qualitatively and quantitatively constant product to be obtained, it enables the results obtained to be compared with those of previous grinding operations, or at least with data considered optimum, it enables the gap between the grinding rolls to be modified to always obtain the required results, it requires no action by specialized personnel as the entire operation is controlled by the control processor, it is of low cost by virtue of the reduction in overall dimensions of the sampling equipment.

I claim:

1. A method for automatically controlling grinding in a milling plant comprising a plurality of grinding stations (2) in parallel arrangement, whose exit ducts (6) are each provided with a switching flap (8) for a duct (9) common to all the ducts (6), characterised by:

taking off, in a prefixed time and according to a ciclic logic, at least a sample of the product coming out from one of the griding stations by switching the flap (8) of the corresponding duct (6), sifting said sample, comparing the passed-through/withdrawn sample percentage value with respect to previously programmed standard values, and adjusting the gap between the rolls (4) of said grinding station (2) on the basis of the deviation from these values.

2. A method as claimed in claim 1, characterised by:

feeding the withdrawn sample to a sifter comprising at least three sets (16, 18, 20) of superposed sieves with their free area decreasing from the top downwards, feeding the rejects leaving the upper sieve (16) to a first balance (24), feeding the passed-through material leaving the lower sieve (20) to a second balance (26), feeding the rejects leaving the intermediate sieve (18) to said first balance (24) or to said second balance (26) according to the station (2) from which the sample is taken, comparing the percentage value of the product quantity contained in the second balance (26)/product quantity contained in both balances (24,26) with respect to previously programmed standard values, and on the basis of the deviation from these standard values, acting on the grinding stations to vary the gap between the rolls.

3. A plant comprising:

a plurality of grinding stations, a plurality of ducts leaving each grinding station and put into communication with a single duct by switching a flap provided at their juncture point, a sifter consisting of at least two superposed sieving units, the exits of which communicate respectively with a first balance and with a second balance, the upper unit communicating only with the first balance, the lower unit communicating only with the second balance, and an intermediate unit communicating with said first or second balance by programming, a data processing system which compares the contents of one balance as a percentage of the contents of both balances with previously memorized values for that type of grinding, and on the basis of the deviation varies the gap between rolls of the grinding station.

4. A plant as claimed in claim 3, characterised in that the duct (9) is connected to a cyclone (10) provided lowerly with an adjustable throughput metering device (12).

5. A plant as claimed in claim 3, characterised in that the duct (9) operates under vacuum.

6. A plant as claimed in claim 3, characterised by comprising an electronic controller (52) which controls the adjustment of the gap between the grinding rolls and the connection of the sieve exits to the balances.

* * * * *